United States Patent [19]

Brehm et al.

[11] 4,080,536

[45] Mar. 21, 1978

[54] X-RAY DIAGNOSTIC ARRANGEMENTS WITH SEVERAL RADIOLOGICAL EXPOSURE SYSTEMS

[75] Inventors: Herbert Brehm, Neunkirchen am Brand; Manfred Haltrich, Erlangen; Eike Matura, Erlangen; Jürgen Reimer, Erlangen; Gerhard Riemke, Spardorf; Günter Wiede, Erlangen, all of Germany

[73] Assignee: Siemens Aktiengesellschaft, Berlin & Munich, Germany

[21] Appl. No.: 683,507

[22] Filed: May 5, 1976

[30] Foreign Application Priority Data

May 30, 1975 Germany ..... 2523887
Mar. 18, 1976 United Kingdom ..... 11033/76

[51] Int. Cl.[2] ..... H05G 1/00

[52] U.S. Cl. ..... 250/407; 250/413; 250/402

[58] Field of Search ..... 250/402, 322, 413, 407

[56] References Cited

U.S. PATENT DOCUMENTS

| | | | |
|---|---|---|---|
| 3,243,591 | 3/1966 | Lesnick et al. | 250/413 |
| 3,409,775 | 11/1968 | Mahler et al. | 250/407 |
| 3,902,069 | 8/1975 | Skarke et al. | 250/402 |
| 3,916,192 | 10/1975 | Schmitmann et al. | 250/402 |
| 3,952,199 | 4/1976 | Franke | 250/402 |
| 3,969,625 | 7/1976 | Finkenzeller et al. | 250/402 |

*Primary Examiner*—Bruce C. Anderson
*Attorney, Agent, or Firm*—Hill, Gross, Simpson, Van Santen, Steadman, Chiara & Simpson

[57] ABSTRACT

An X-ray diagnostic arrangement in which a plurality of radiological exposure systems and a common power supply and control panel are provided. The control panel has a control unit for the exposure systems. A selector unit has switching elements for organ programmed setting of exposure values for each exposure system. A manually operated switching unit connects any one of the exposure systems to the power supply and the control unit. Each selectable position of the selector unit corresponds to several exposure value combinations, and a program selector with switching positions is connected to all selectable positions so that one exposure value combination can be selected for each selectable position in each switching position of the program selector. The switching unit for connecting one of the exposure systems to the power supply and the control unit is actuated jointly with the program selector.

3 Claims, 5 Drawing Figures

X-RAY DIAGNOSTIC ARRANGEMENTS WITH SEVERAL RADIOLOGICAL EXPOSURE SYSTEMS

BACKGROUND OF THE INVENTION

The present invention relates to an X-ray diagnostic installation with several radiological exposure systems, a power supply and a common control panel which has a control device for the exposure systems, and a selector device with switching means for the organ-programmed setting of exposure values for each exposure system. A manually operated switch arrangement connects either one of the exposure systems to the supply and control device.

With a known X-ray diagnostic installation of this type, the control panel has 36 organ keys for 36 exposure types which can be made with the several operational locations. Because of the large number of keys for selecting the exposure values, the conventionally known control panel is extremely cumbersome to operate.

It is, therefore, an object of the present invention to provide an X-ray diagnostic arrangement of the initially described type, in which the selector device for the organ-programmed setting of exposure values has considerably fewer switching means than the conventionally known control panel.

Another object of the present invention is to provide an X-ray diagnostic arrangement of the foregoing character which may be economically fabricated and maintained in service.

A further object of the present invention is to provide an X-ray diagnostic arrangement, as described, which has a substantially long operating life.

SUMMARY OF THE INVENTION

The objects of the present invention are achieved by providing that for each selective position of the selector device, several exposure value combinations are assigned. A program selector, common to all selective positions, can select an exposure value combination for each of its switch positions. The principal difference between the state of the art and the X-ray diagnostic installation in accordance with the present invention is as follows: In each selective position, e.g. by each organ key, several exposure value combinations can be selected and there is provided means by which the desired exposure value combination can be selected. With the control panel of the X-ray diagnostic installation in accordance with the present invention, a number of selecting positions for the organ programmed setting of exposure values is required, which otherwise would be necessary for a single exposure system. In contrast, the total number of organ keys with the known control panel equals the sum of organ keys required for the individual exposure systems.

A particularly advantageous embodiment of the present invention is the location, at the control panel near the selector device for the organ-programmed setting of exposure values, of display panels or charts which can be spread open like a book. On these panels, the body parts associated with the selective positions are drawn in such a way that when flipping the display panels or filp charts, the body parts associated with a select position of the selector device are all in a column near the select position. When flipping to the display panels associated with the selected exposure system, there is an automatic display of the body parts associated with the various select positions of the organ selector device. In accordance with another embodiment, the program selector may be in operative connection with the display panels or flip charts, so that when flipping the respective display panels, the associated exposure values program of the selector device is selected automatically. Thus, the operator with this embodiment, by flipping to the correct chart, selects the exposure values program for the organ selector device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
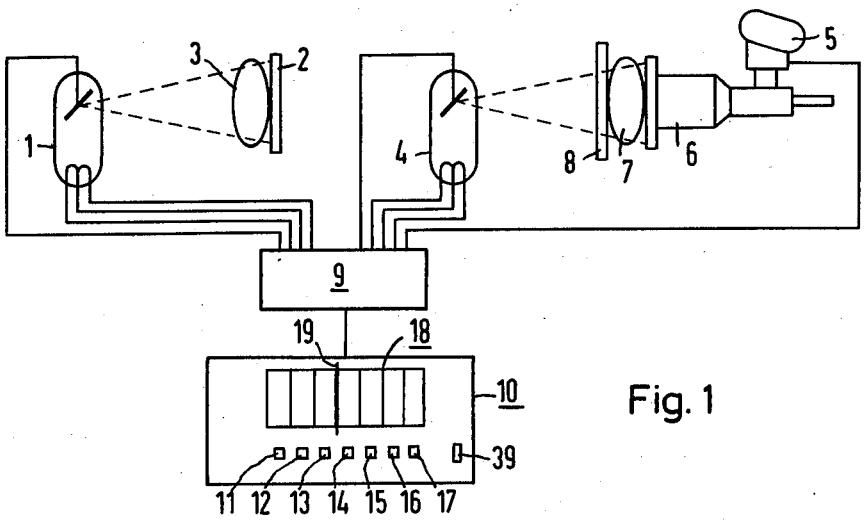
FIG. 1 shows a schematic of an X-ray diagnostic installation in accordance with the present invention.

FIG. 1 shows two exposure systems for X-ray pictures, one of which systems comprises an X-ray tube 1 and an X-ray film magazine 2 which is fastened to a wall stand. The patient 3 is pictured by the X-ray radiation of X-ray tube 1 on the X-ray filmin magazine 2. The X-ray tube 1 has two focusses and two filaments, one of which can be selected.

The second exposure system comprises an X-ray tube 4 and a film camera 5 which is coupled to the output screen of a X-ray picture amplifier 6. The patient 7 is lying on a table 8. X-ray tube 4 also has two focusses. The exposure systems 1, 2 and 4 through 6 are connected to a common supply and control device 9 which comprises a high-voltage generator and means for making the exposure settings, such as X-ray high voltage and mAs product or sensitivity of an exposure automatic system. For selecting the exposure values, there is a common control panel 10 which has organ keys 11 through 17. To each one of organ keys 11 through 17, which constitute the switching means for a selector device, several exposure value combinations are assigned; in the embodiment described here, there are two exposure value combinations associated with the two exposure systems 1, 2 and 4 through 6.

Adjacent to organ keys 11 through 17 there are display panels 18 which will be described below in conjunction with FIGS. 4 and 5. The display panels 18 spread like a book about an axis 19 and bear the designations of the human body parts associated with organ keys 11 through 17. For the sake of brevity, these body parts are not shown in FIG. 1. They are displayed in the seven columns indicated so that, when the display panels 18 are spread open, the associated organs are displayed. The selection of the exposure combinations obtainable by the organ keys 11 through 17 is accomplished by a switch which is actuated by the display panels 18. When spread open to the desired display panel, each of the organ keys 11 through 17 is assigned the associated exposure value combination and the associated exposure system is connected to the supply and control device 9. This will be explained in detail by means of FIG. 2.

Figure 2:
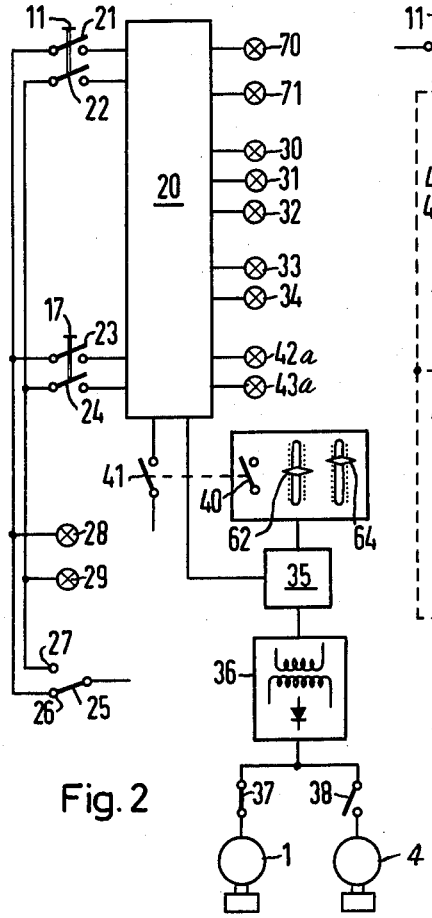
FIG. 2 shows a circuit diagram to explain the X-ray diagnostic installation of FIG. 1.

FIG. 2 shows a program control device 20 to which the contacts of organ keys 11 through 17 are connected. FIG. 2 shows only the contacts 21 and 22 of organ key 11 and the contacts 23 and 24 of organ key 17. To the program control device 20, there is connected a program selector 25 which is reset when the display panels 18 are changed from one position to another position, between the fixed contacts 26 and 27. Pilot lamps 28 and 29 in control panel 10 indicate which program has been selected. Depending on the position of program selector 25, the contacts 21 and 23 of organ keys 11 and 17 and the corresponding contacts of organ keys 12 through 16 or the contacts 22 and 24 and the associated other contacts are connected to the program control device 20. Hence, when pressing one of keys 11 through 17, in accordance with the position of the program selector 25, each key selects one of two possible exposure value combinations.

To program control device 20 there are connected lamps 70 and 71 which indicate which exposure system has been selected by spreading open the display panels. Three lamps 30 through 32 indicate the required amplifier foil in the exposure magazine 2. The focus selected is indicated by two lamps 33 and 34.

The exposure values selected in the program control device 20 by pressing an organ key act on correcting or control elements 35 for a high-voltage generator 36 to set the exposure values. The high-voltage generator 36 feeds to the selected exposure system either the X-ray tube 1 or the X-ray tube 4. Switches 37 and 38 are used for selecting the desired exposure system.

The example of FIGS. 1 and 2 shows that fourteen different exposure value combinations can be selected by seven organ keys. If the program selector 25 is expanded and additional contacts are assigned to organ keys 11 through 17, an additional expansion is possible. Hence, with the X-ray diagnostic installation described, a large number of exposure value combinations can be selected with relatively few organ keys. The display of the body parts associated with the individual keys by means of display panels 18, proceeds in a particularly simple and expedient manner.

Figure 3:
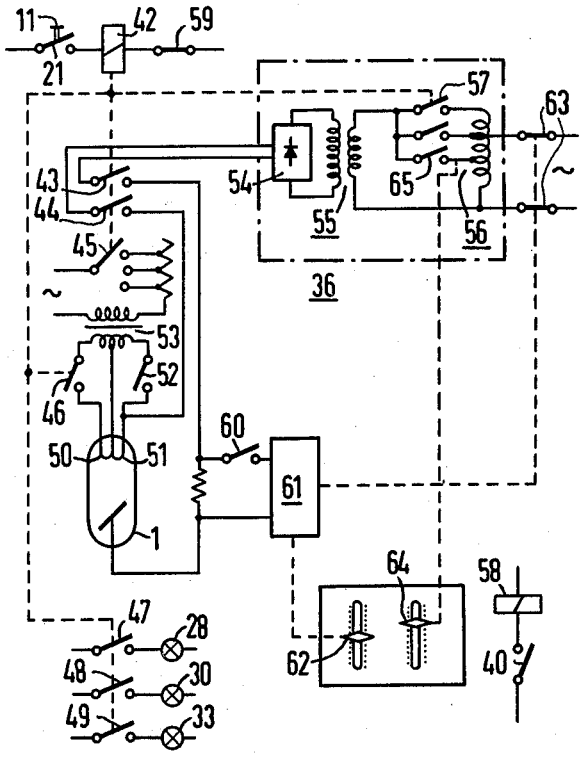
FIG. 3 shows a portion of the circuit diagram of FIG. 2 in detail.

If a free exposure value setting is desired, a key 39 on control panel 10 is actuated. The key 39 closes a contact 40 and connects an mAs selector 62 and a kV selector 64 to the control elements 35. The contact 41 which also is actuated by key 39 cancels the setting for the mAs product and for the X-ray tube voltage through organ keys 11 through 17. Lamps **42*a* and 43*a* indicate whether a free or programmed setting of all exposure values takes place. The lamps 28 through 34 and 42*a*, 43*a* are located in control panel 10, but are not shown in FIG. 1 for the sake of brevity and clarity. Below, the setting for the exposure values by means of organ keys 11 through 17 is explained in detail by means of FIG. 3. FIG. 3 shows a contact 21 of organ key 11. If this contact is closed, a relay 42 with contacts 43 through 49 is energized. The broken line indicates that these contacts are actuated by the winding of relay 42. FIG. 3 shows the X-ray tube 1. The two filaments are denoted by 50 and 51. They can be connected via contact 46 and a contact 52 to a filament voltage transformer 53. The anode voltage for the X-ray tube 1 is generated by a high-voltage rectifier 54 which is located at the output of a high-voltage transformer 55. A variable ratio transformer 56 is connected ahead of the high-voltage transformer 55**.

If organ key 11 is pressed, the contacts 43 through 49 of relay 42 are closed as the result of it being energized. The contacts 43 and 44 connect the X-ray tube 1 to the output of high-voltage generator 36. Hence they correspond to the switch 37 of FIG. 2. The contact 45 selects the resistance in the filament circuit which determines the filament current and hence the X-ray tube current. The contact 46 selects the focus associated with filament 50. Assume that with pressing the organ key 11, lamps 28, 30 and 33 are turned on. This turning-on is accomplished via contacts 47 through 49. The contact 57 selects the high voltage assigned to key 11 and its contacts 21.

Hence, pressing the organ key automatically selects the X-ray tube voltage, the X-ray tube current and the focus, and turns on the associated pilot lamps. In the same manner, the other contacts of organ key 11 energize additional relays which select these magnitudes in accordance with another program. In an analog fashion, relay windings are associated with the contacts of the other organ keys. A known X-ray exposure automatic shutoff system terminates the X-ray exposures.

If the exposure data are to be set freely, switch 40 is closed and relay 58 is energized. This relay opens its contacts 59 and disconnects relay 42. It also closes its contact 60 and energizes a mAs relay 61. By means of slide 62, the mAs relay 61 can be set which, in the conventional manner, upon reaching a predetermined mAs product, opens switches 63 in the primary circuit of the high-voltage transformer and terminates the exposure. The kV selector 64 acts in a manner already known in the art on the variable ratio transformer 56 to adjust the high voltage on X-ray tube 1.

FIG. 3 indicates that relay 42 with its contacts 43 through 49 and 57 is part of program control device 20. The latter also contains the other relays associated with organ keys 11 through 17.

The kV selector 64 is switched on by a contact 65 of relay 58 upon it being energized. With switch 40 opened, contacts 63 are actuated by said exposure automatic shutoff system.

Figure 4:
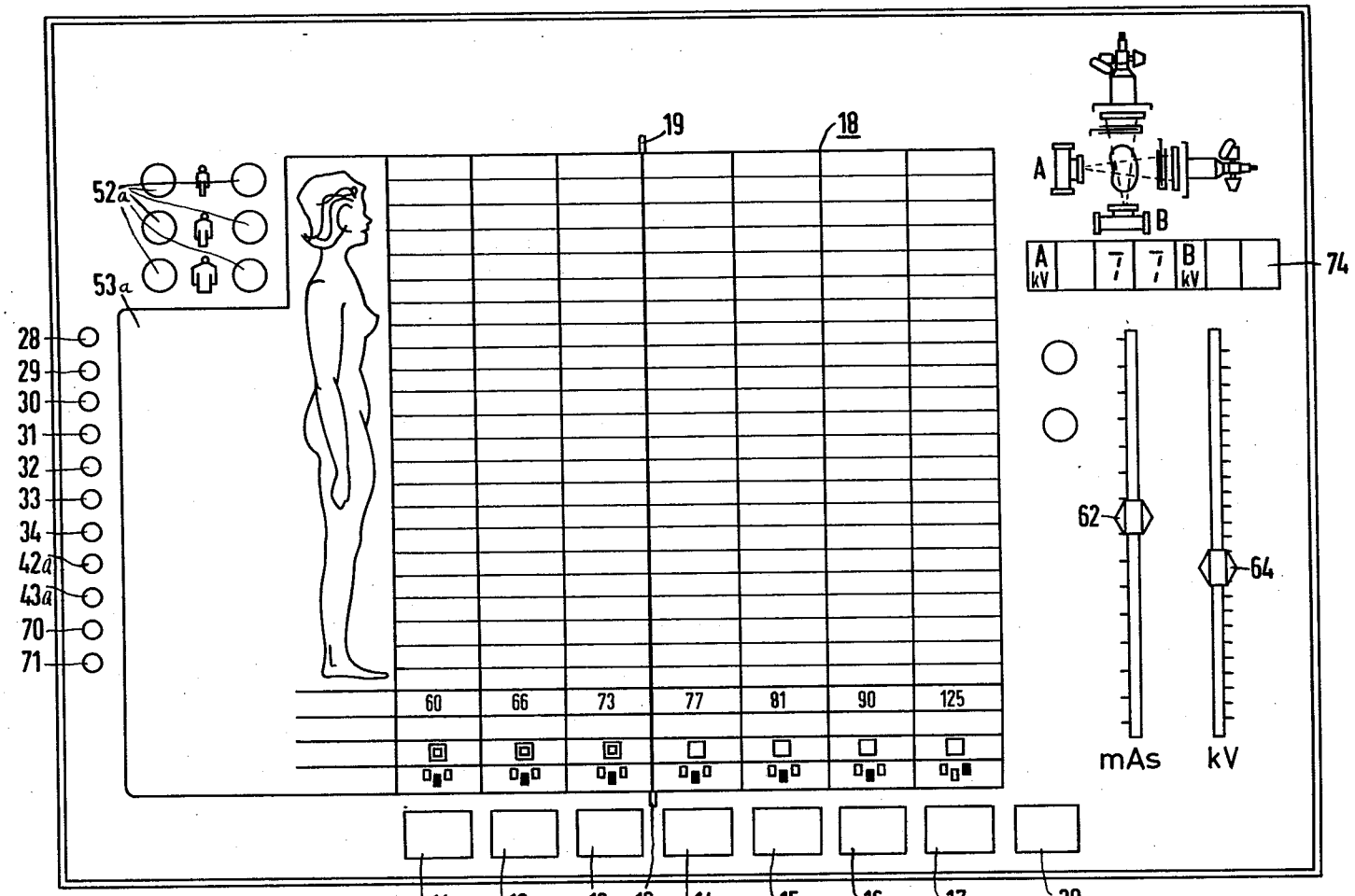
FIGS. 4 and 5 show a view of the control panel of an X-ray diagnostic installation in accordance with the present invention.

FIG. 4 shows the details of control panel 10. The program selector 25 is actuated, as previously stated, by turning over the display panels.

It is an integral element and feature of the X-ray diagnostic installation that to each of organ keys 11 through 17 several exposure value combinations are assigned and that, via the program selector 25 in each of its switching positions, one exposure value combination can be selected for each organ key 11 through 17. Hence, with more than two exposure systems, there must be more than two contacts for each organ key 11 through 17. These contacts are selected by the program selector 25.

The display panels 18 have a position showing the body parts assigned to the exposure system 1, 2. Above each of organ keys 11 through 17, the associated body parts are shown in a column. Easy location of the body parts is facilitated by the drawing of a human body at the edge of the left-hand display panel. With each of organ keys 11 through 17, the X-ray tube voltage, the foil or film to be used, the focus selected, and the selected dominant are shown. For free operation, key 39 is pressed. The mAs product and the X-ray tube voltage can be set by selector 62 and 64. With exposure automatic operation, when key 39 is not pressed, an adaptation to the condition of the patient is possible via keys 52*a*. Pilot lamps 28 through 34, 42*a*, 43*a*, 70 and 71 are shown to the left of the control panel.

Figure 5:
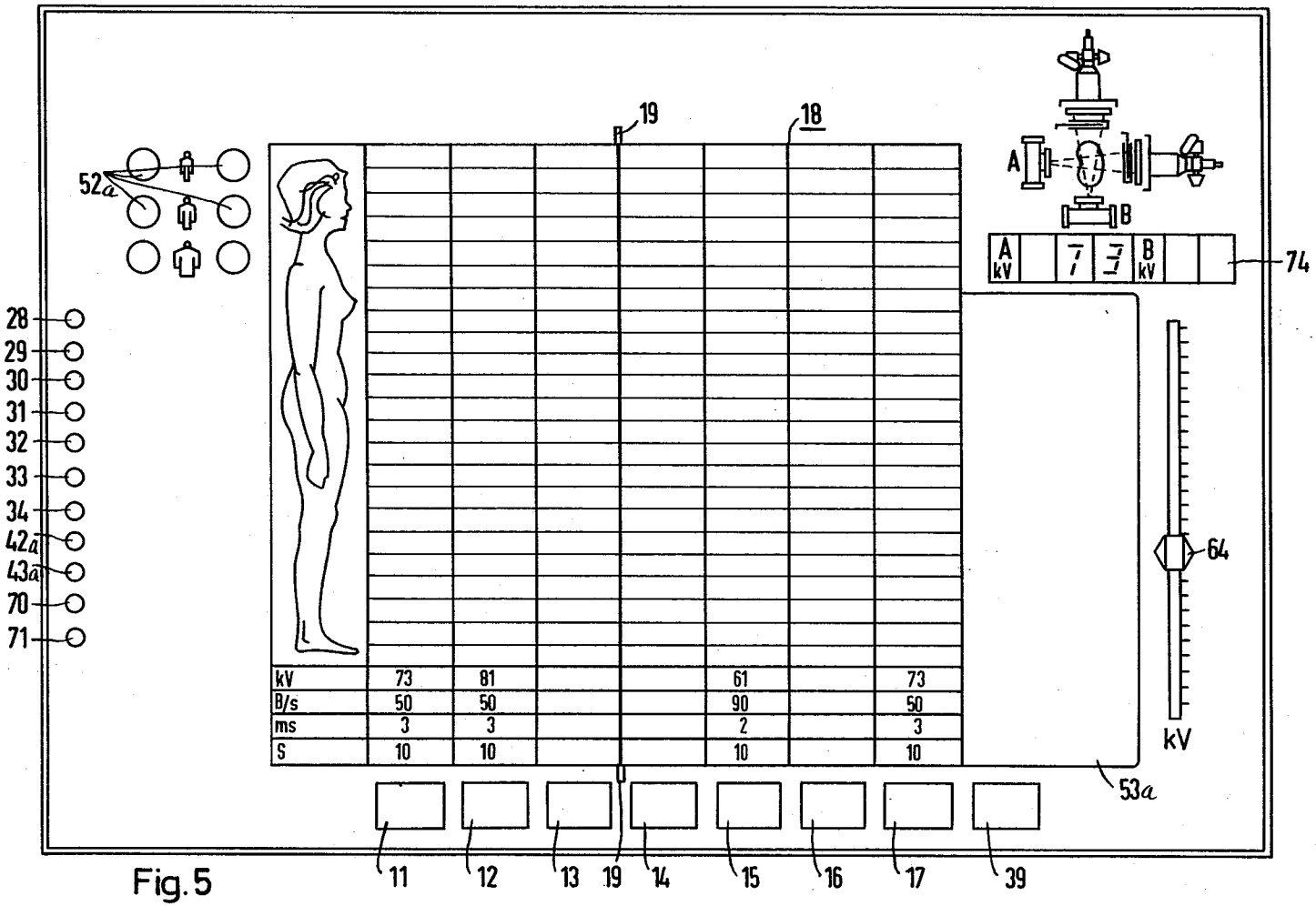

FIG. 5 shows the position of display panels 18 applicable to exposure systems 4 through 6. A setting for mAs product is not possible and the mAs selector 50 is covered by a projection 53*a* on one display panel. Only the X-ray tube voltage can be adjusted when pushbutton 39 is pushed. Again, the associated body parts are shown in a column above each of organ keys 11 through 17. A display 74 indicates if the machine is operating properly or not while the X-rays are being taken. This display is furnished by a two-plane seriography (serial radiography) installation. The individual parts of the installation can be illuminated to indicate any possible problems.

Actuation of switches 37 and 38 for connecting either of X-ray tubes 1 and 4 to the high-voltage generator 36, may also take place jointly with the actuation of the program selector 25 by flipping over the display charts or panels 18.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. An X-ray diagnostic arrangement comprising in combination at least two radiological exposure systems with each system including a separate X-ray tube; a common power supply for said exposure systems; a common control panel having control means for each of said exposure systems; a manually operated switch unit for connecting a selected one of said exposure systems to said power supply and said control means; said control means having selector means for selecting a desired programmed setting of an exposure value for one of the exposure systems and including a plurality of organ keys with each organ key actuating at least two switch means with each switch means controlling a desired exposure value, a program selector with switching positions and being connected to all of the switch means so that one exposure value combination is selected for each of the organ keys in each switching position of the program selector; and a display panel on said control panel adjacent to said organ keys of said selector means, said display panel being joined in book form and turnable as leaves of a book, each panel bearing an organ part associated with each of the organ keys so that when turning to a desired display panel, the body organ parts associated with the respective organ keys of the selector means are all displayed in a column adjacent the organ keys; and means for operatively connecting said program selector with said display panels so that when a selected display panel is turned, the respective switching position of the program selector occurs automatically and each of the organ keys will produce the desired exposure value for the organ display on the panel for the respective key.

2. The X-ray diagnostic arrangement as defined in claim 1, including means for actuating jointly said switching unit with said program selector.

3. The X-ray diagnostic arrangement as defined in claim 1, wherein said display panels comprise flip charts.

* * * * *